US006792835B1

(12) United States Patent
Quick et al.

(10) Patent No.: US 6,792,835 B1
(45) Date of Patent: Sep. 21, 2004

(54) MULTI-PURPOSE UNIVERSAL SOCKET TOOL

(75) Inventors: Stephen Quick, West Boylston, MA (US); Joel S. Marks, Sherman Oaks, CA (US); Michael Marks, South Orleans, MA (US)

(73) Assignee: Endeavor Tool Company, LLC, West Boylston, MA (US)

( * ) Notice: Subject to any disclaimer, the term of this patent is extended or adjusted under 35 U.S.C. 154(b) by 39 days.

(21) Appl. No.: 10/341,818

(22) Filed: Jan. 14, 2003

Related U.S. Application Data

(63) Continuation-in-part of application No. 09/684,262, filed on Oct. 6, 2000, now abandoned.

(51) Int. Cl.[7] ..... B25B 23/00; B25B 13/58

(52) U.S. Cl. ..... 81/177.2; 81/180.1; 81/177.85

(58) Field of Search ..... 81/177.2, 177.85, 81/177.5, 180.1

(56) References Cited

U.S. PATENT DOCUMENTS

| | | | | |
|---|---|---|---|---|
| 3,875,829 A | * | 4/1975 | Evans et al. | 81/177.2 |
| 4,526,069 A | | 7/1985 | Cecil | |
| 4,744,272 A | | 5/1988 | Leatherman | |
| 4,817,475 A | | 4/1989 | Kelly et al. | |
| 4,887,498 A | | 12/1989 | Zayat | |
| 5,216,940 A | * | 6/1993 | Hedden | 81/177.2 |
| 5,438,894 A | | 8/1995 | Pearce | |
| 5,622,090 A | | 4/1997 | Marks | |
| 5,791,209 A | | 8/1998 | Marks | |
| 5,794,496 A | | 8/1998 | Arnold | |
| 5,819,606 A | | 10/1998 | Arnold | |
| 5,927,164 A | | 7/1999 | Anderson et al. | |
| 5,957,012 A | | 9/1999 | McCune | |
| 5,979,059 A | | 11/1999 | Leatherman et al. | |
| 6,000,080 A | | 12/1999 | Anderson et al. | |
| 6,019,019 A | | 2/2000 | Hobbs | |
| 6,314,600 B1 | | 11/2001 | Cachot | |
| D455,939 S | | 4/2002 | Allen | |
| 6,604,441 B2 | * | 8/2003 | Lin | 81/177.2 |

* cited by examiner

*Primary Examiner*—Debra Meislin
(74) *Attorney, Agent, or Firm*—Paul Y. Feng; Fulwider Patton Lee & Utecht, LLP

(57) ABSTRACT

A tool assembly includes a multi-purpose tool, an adaptor and a socket wrench. The multi-purpose tool includes a body that contains implements such as knives, openers, scissors and other such devices. A fixed plier jaw extends from the body, and a movable plier jaw pivots about the body to a closed position against the fixed plier jaw. The closed plier jaws include an opening that surrounds and engages a driven section of the adaptor. The driven section includes an elongated cross-section to form a long torque arm within the closed jaw opening. A flange at each end of the driven section holds the adaptor in an axial direction. A universal socket may be attached to the driven end of the adaptor to provide a wrench suitable for many fastener shapes.

17 Claims, 5 Drawing Sheets

MULTI-PURPOSE UNIVERSAL SOCKET TOOL

CROSS-REFERENCE TO RELATED APPLICATIONS

This is a continuation-in-part (CIP) application parent application having U.S. Ser. No. 09/684,262, filed Oct. 6, 2000, now abandoned whose entire contents are hereby incorporated by reference.

FIELD OF THE INVENTION

The present invention relates to multi-purpose hand tools. More precisely the present invention relates to a nut-driving element of a multi-purpose tool.

BACKGROUND OF THE INVENTION

It has long been known to combine multiple hand tools together into one device to provide economy or compactness. An early such example is a double-ended wrench body with a different size opening at each end. Another such device is a universal socket such as those disclosed in U.S. Pat. Nos. 5,622,090 and 5,791,209 to Marks. These wrenches use bundled, separately movable pins within a socket body. The pins move axially to surround a bolt head or other object to apply torque to the object.

Another category of multi-purpose tools uses a pocket-knife type structure including various folding implements. Of present interest are such tools that include a fastener driver or wrench implements. U.S. Pat. No. 4,744,272 to Leatherman is a well-known example in this category. A foldable handle set fits over a plier jaw, and deploys out and rearward to form plier handle extensions. Each handle contains other usable implements that can further fold out. U.S. Design Pat. No. D455,939 to Allen shows a multi-purpose tool with an adjustable wrench at one end. Another example of a wrench type tool is U.S. Pat. No. 6,314,600 to Cachot. A main body has a fixed plier jaw extending from one end. The body serves as one of the two plier handle extensions. A second jaw element opposes the fixed jaw, with a respective handle extension protruding rearward from an opposed side of the main body, the plier element of the second jaw and handle pivoting within the main body. A hexagonal aperture in the side of the body receives screw driving attachments.

An adaptor may be used to link one type of driving tool to another. U.S. Pat. No. 6,019,019 to Hobbs and U.S. Pat. No. 5,438,894 to Pearce show adaptor type devices. The Hobbs '019 reference includes a driving end of square section to engage standard socket wrenches. The driven end is entirely smaller than the driving (square) end. The driven end describes at its twelve vertices a generally circular shape to fit "standard wrenches" as described. In Pearce '894, the driven end comprises parallel flats of a hexagon to fit an open end wrench where the "jaws are horizontal." The driven end is similarly generally circular by its six vertices.

U.S. Pat. No. 4,817,475 to Kelly shows a socket with a driven end engageable by a hexagonal outer circumference. It is identical to a common spark plug wrench wherein an exterior of the socket is faceted so that a wrench may surround and engage the socket. The socket of Kelly '475 includes a separate retaining ring that is installed after the wrench is positioned around the socket to keep the wrench semi-permanently axially held to the socket.

U.S. Pat. Nos. 5,794,496 and 5,819,606 to Arnold disclose socket wrench devices. In Arnold '496, a pawl system is associated with a socket design. The disclosure teaches that portion 76 of "socket" 72 of FIG. 12 is described as having an opening 80 with surfaces 82 formed therein, (col. 4, line 52), while a protruding stem 67 is shown instead in FIG. 12. The intended reference is apparently to the integrated pawl and socket as shown in FIGS. 13 to 23 where integrated pawl/socket 76 is clearly shown. "Opening 80" would be the recess immediately to the left of numeral 72 in FIG. 15, where faceted "surfaces 82" are visible within. FIG. 15 shows a typical retaining method to hold the socket in the housing. A flange is formed above channel 86. Necessarily this flange is of equal or lesser diameter than the portion of the socket below to enable the socket to be installed and retained in the housing. See also FIG. 22.

In Arnold '606, FIGS. 1 to 14 show sockets with a channel and an upper flange. These sockets are of the type disclosed in Arnold '496 as stated in col. 4 line 17 of Arnold '606. Therefore, the flange does not directly serve a retaining function, except by way of the retaining ring of Arnold '496 that is fitted into the channel.

It is common that a plier includes curved recesses in the jaw faces. These recesses are usually serrated to provide gripping power upon driven objects. Such recesses are visible for example in jaws 10 of Leatherman '272. When the jaws are fully closed the recesses form a narrow elongated opening through the closed jaws. The opening is often but not always of ovoid shape. In a plier of practical size this opening is too small to firmly grip generally round objects even with the serrations. Only when gripped upon larger objects in an opened jaw condition can the plier recesses apply strong torque to a generally round object.

SUMMARY OF THE INVENTION

It is desirable to provide a driving system where a fully closed plier can apply strong torque to a driving implement. In such a design the pliers can be used in its most compact state. When the pliers is integrated as part of a multi-purpose tool it is also desirable that the overall size of the tool be minimized when the tool is connected to a driving implement. It is therefore an object of the invention to provide a system that strongly links a plier to a driven device such as a socket wrench. It is a further object of the invention to have the plier strongly grip a driven device with the plier in a closed position. It is a related object to include an adaptor with a driven section that is of an elongated non-round sectional shape that fills an elongated narrow opening formed jaws by recesses in the jaw faces of a closed plier. It is another object of the invention to provide a system wherein a multi-purpose tool is used to drive a universal socket wrench.

According to one embodiment of the present invention system, a multi-purpose tool includes a body portion with various implements within the body portion. A fixed plier jaw extends forward from the body. The body portion forms a rearward-extending handle of the fixed jaw. A movable plier element pivots about the body, with a forward extending movable jaw opposed to the fixed jaw and a pivoting handle extending rearward on an opposite side of the body from the movable jaw. The plier jaws include recesses in each jaw face so that when the jaws are closed together, such that the jaw faces are proximate to each other, the opposed recesses form an elongated opening through a thickness of the jaws. The elongated opening is constricted at each end of the opening to form an enclosure so that an object within the opening is substantially fully surrounded.

In one embodiment of the present invention, both rearward-extending portions of the tool house implements.

In this case there may be no preferably "fixed" jaw, but rather two relatively moving "bodies" with associated jaws.

The present invention optionally includes an adaptor. The adaptor comprises a square sectioned driving end to fit standard socket wrenches. The driven section of the adaptor includes an elongated, preferably non-circular sectional shape. This shape substantially fills the elongated opening in the closed plier jaws. The length of the elongated shape defines the torsion arm available that links the plier to the adaptor and thus the socket wrench. The present invention shape contrasts with generally round shapes of the prior art adaptors. These conventional round shapes present a very small torsion arm within the elongated opening of a closed plier jaw. The prior art adaptors thus suffer from the possibility of slippage and a loss of torque transmission.

The present invention plier handles may include a locking device such as a movable loop or hook near a distal end of the plier handles so that the plier jaws can be held closed and secured about the adaptor without an applied squeezing force. Therefore, the locking device along with the unique shape of the adaptor ensure highly efficient torque transmission with minimal hand-squeezing effort by the user.

The adaptor includes optional flanges both above and below the driven section so that the pliers are axially retained upon the adaptor. A two-ended flange is possible in the present invention because the wrench driving means is a non-rigid structure; it is a closable plier jaw that can be configured in the ordinary course of use to both fit about and release the driven section of the adaptor. The adaptor is thus retained axially by the flanges and radially by the enclosure formed by the opening in the jaws.

The present invention system further employs an optional universal socket. In one embodiment, the universal socket includes a bundle of longitudinally movable pins with the socket. Respective pins will retract when pressed over a bolt head or other fastener. The remaining pins will surround the bolt head so that torque may be transmitted by the pins from the bolt head to the interior wall of the socket. Accordingly, the concerted action of the bundled pins and wall design improve torque transmission as well as the broadening the suitability of the socket tool for use on unconventional shapes (i.e., stripped nuts, broken plumbing handles, etc.).

The present invention is thus a unification of multiple tools into one compact and efficient system or assembly. To be sure, the present invention system or assembly seamlessly incorporates tools that are distinct in nature and typically not found together in one tool. For instance, the present invention enhances the utility of a multi-purpose tool by expanding its application to an entire class of socket tools.

DETAILED DESCRIPTION OF THE PREFERRED EMBODIMENTS

Figure 1:
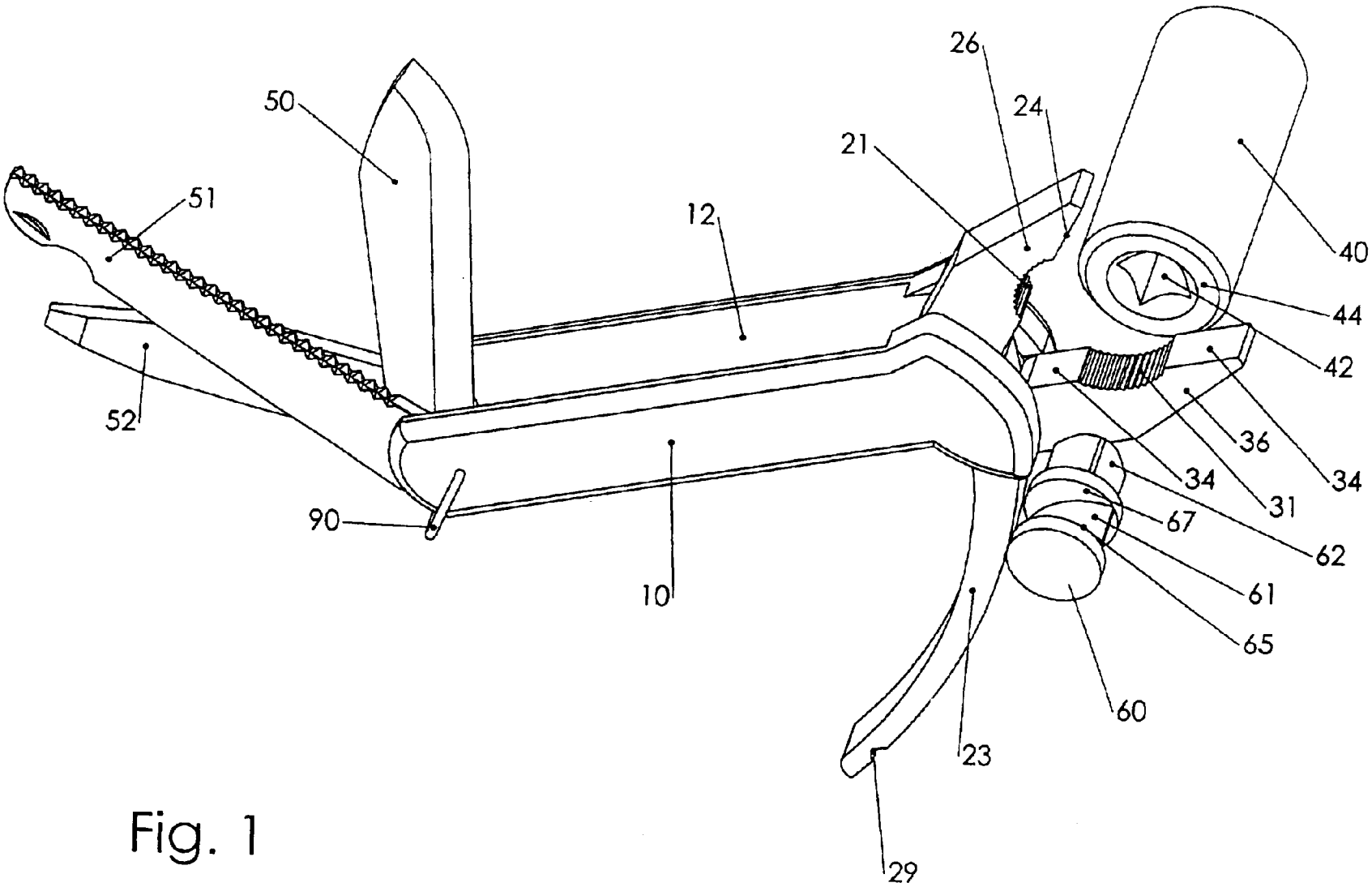
FIG. 1 is an isometric exploded view of one embodiment of the present invention multi-purpose universal socket tool assembly.

FIGS. 1 to 4 show various configurations of one embodiment of the present invention tool assembly. Specifically shown in FIGS. 1 and 2, every exemplary internal implement of the multi-purpose tool is opened or deployed. Knife blade 50, saw 51, and opener/screwdriver 52 are typical implements that may be included in a multi-purpose tool. Other implements known in the art such as corkscrews, scissors, files, wrenches, awls, etc., are also contemplated although not shown. The implements store or at least are partially contained in cavity 12 of elongated body 10. If desired, handle 23 could comprise a body that contains additional implements.

Figure 5:
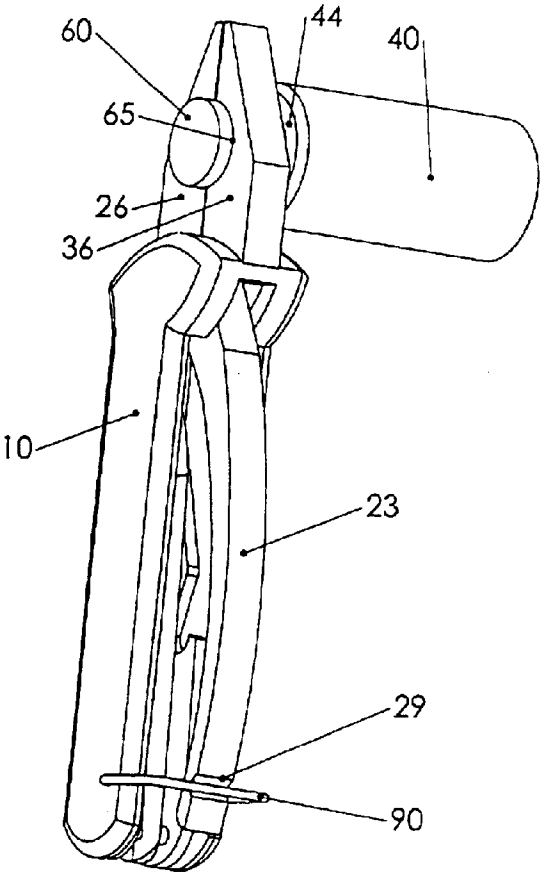
FIG. 5 is the tool assembly of FIG. 4, rotated approximately 180° from FIG. 4 about a long axis of the tool body.
Figure 4:
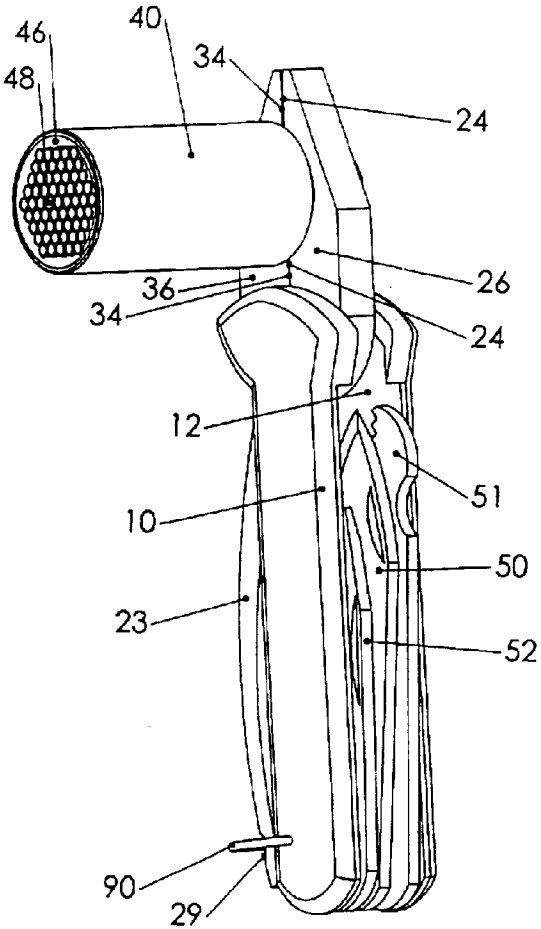
FIG. 4 is the tool assembly of FIG. 3, with the movable jaw closed about the adaptor, and a handle lock activated.
Figure 9:
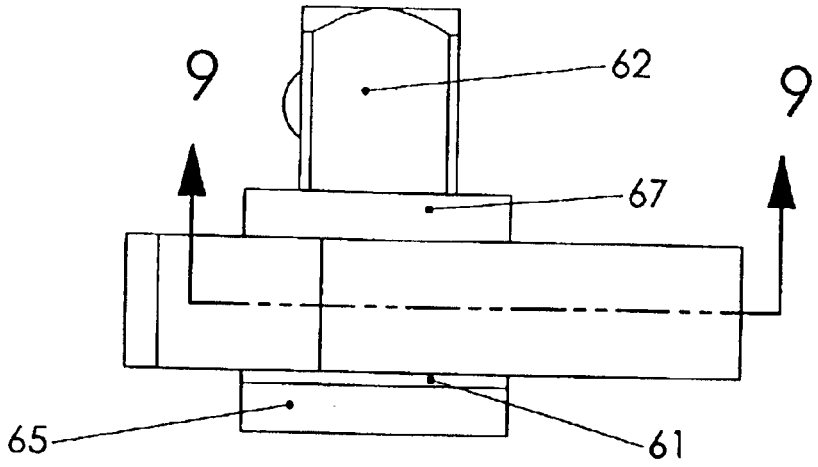
FIG. 9 is an end view of an assembly of a closed plier jaw and an adaptor.

The movable plier element preferably comprising the combination of rearward extending handle 23 with forward extending jaw 26 pivots about body 10. Fixed jaw 36 extends from body 10 in opposition to movable jaw 26. Pressing handle 23 toward body 10 causes the jaws to close together as shown in FIGS. 4 and 5. Which handle, if either, with the respective jaw that is movable among the pair of pivotally linked jaws is mostly arbitrary, and somewhat dependent on how the tool is held, which handle is larger, or other criteria. In the illustrated embodiment, it is natural that the movable plier element is considered to be handle 23 with jaw 26 since body 10 is much larger than handle 23.

Figure 2:
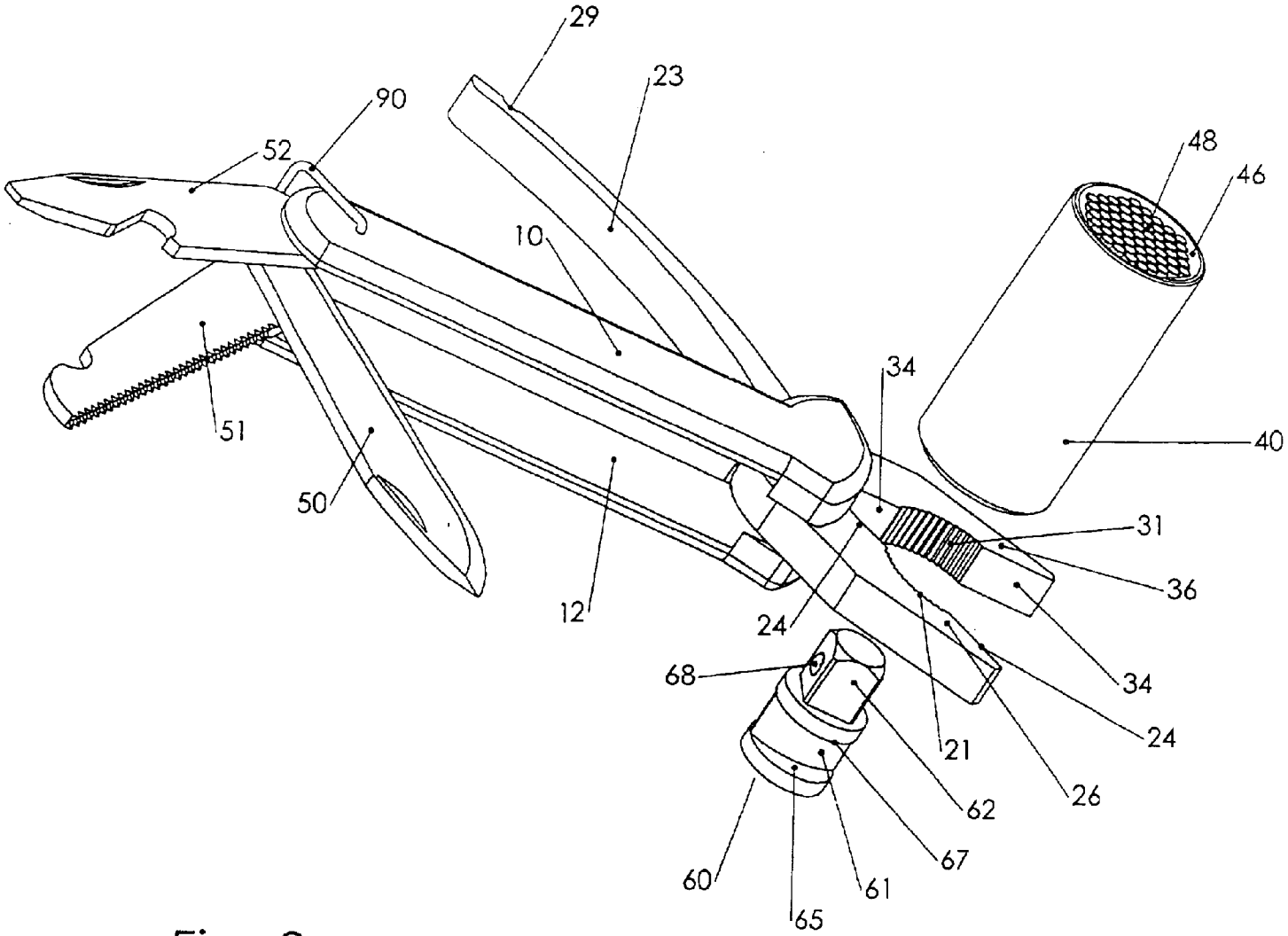
FIG. 2 is the tool assembly of FIG. 1, rotated approximately 90° from FIG. 1 along a long axis of the tool body.

In the exploded views of FIGS. 1 and 2, adaptor 60 is axially aligned with socket 40. The exemplary embodiment adaptor 60 includes driven section 61, upper flange 65, lower flange 67, and driving extension end 62. The flanges 65, 67 are at opposite ends of the driven section 61.

Figure 7:
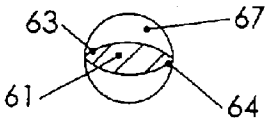
FIG. 7 is the adaptor of FIG. 6, viewed in partial cross-section taken along line 7—7.
Figure 8:
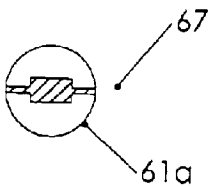
FIG. 8 is an alternative sectional shape for an adaptor.
Figure 10:
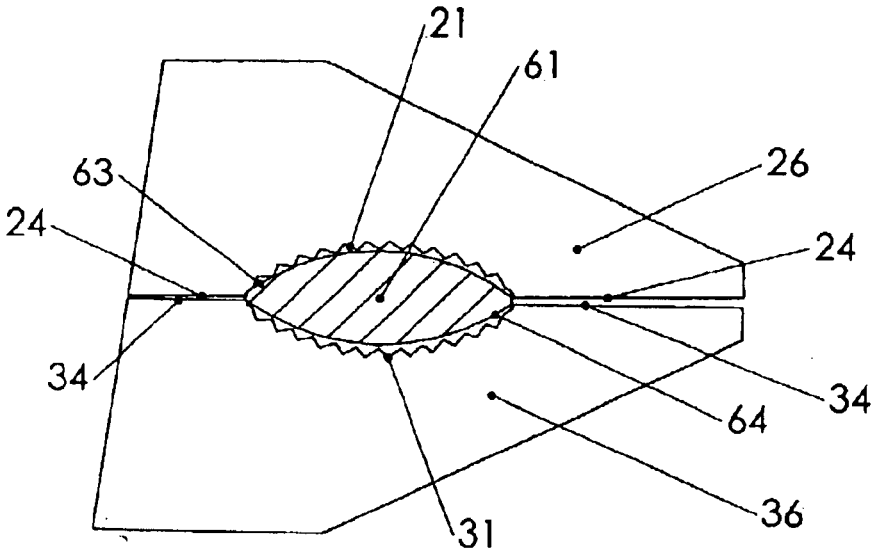
FIG. 10 is a partial top plan view of the closed plier jaw of FIG. 9, with the adaptor in a cross-sectional view.

Driving end 62 preferably has a square section to fit square receptacle 42 of socket 40. A retaining means, in this embodiment, a spring biased ball 68 shown in FIG. 2, is optionally provided. Other sectional shapes may be desired here. Driven section 61 includes a sectional profile that is elongated as seen in FIGS. 7, 8, and 10. In the preferred embodiment, the cross-section is essentially ovoid or an oval, generally defined as two convex arcuate surfaces joined at the intersecting arc ends. The span between the arc ends defines a length of the elongated driven section, the length being horizontal in FIG. 7. A width of section 61 is vertical in FIG. 7. The length of section 61 is substantially greater than the width, with a minimum ratio of 2:1 length verses maximum width to present a practical turning surface or torsion arm within the elongated recess of the plier jaws. Other sectional shapes could be used such as rectilinear polygon, or notched rectilinear polygon as seen in FIG. 8. In FIG. 8, section 61*a* has narrow extensions from a rectangular center part. The ovoid section 61 of FIG. 7 represents a simple shape that substantially fills the commonly ovoid opening in the closed plier jaw, as best shown in FIG. 10. In the case of both sections 61 and 61*a*, the torsion arm that links the plier to adaptor 60 is defined by the long dimension of section 61 or 61*a*, approximately the distance between surface locations 63 and 64, as best seen in FIGS. 7 and 10.

Under torque, the present invention adaptor 60 will press within the jaw opening at the ends of the elongated driven section; in the case of the ovoid section 61, the pressing action is at the arc ends. That is, the adaptor 60 presses at two locations of ovoid section 61, on opposites sides of section 61. In FIG. 10 these ends are at surface locations 63 and 64, near the distal ends of the length of ovoid section 61. Forcing the closed plier jaw counterclockwise in FIG. 10 will cause recesses 21 and 31 to press ovoid section 61 at surface locations 63 and 64 on respective first and second sides of ovoid section 61. Ovoid section 61 thus includes two arcuate sides with a maximum width or thickness near a mid point of the arcs, and two longitudinal ends. Similarly the jaws would press at distal ends on opposing sides of the narrow segments of the polygonal shape shown in FIG. 8.

Figure 3:
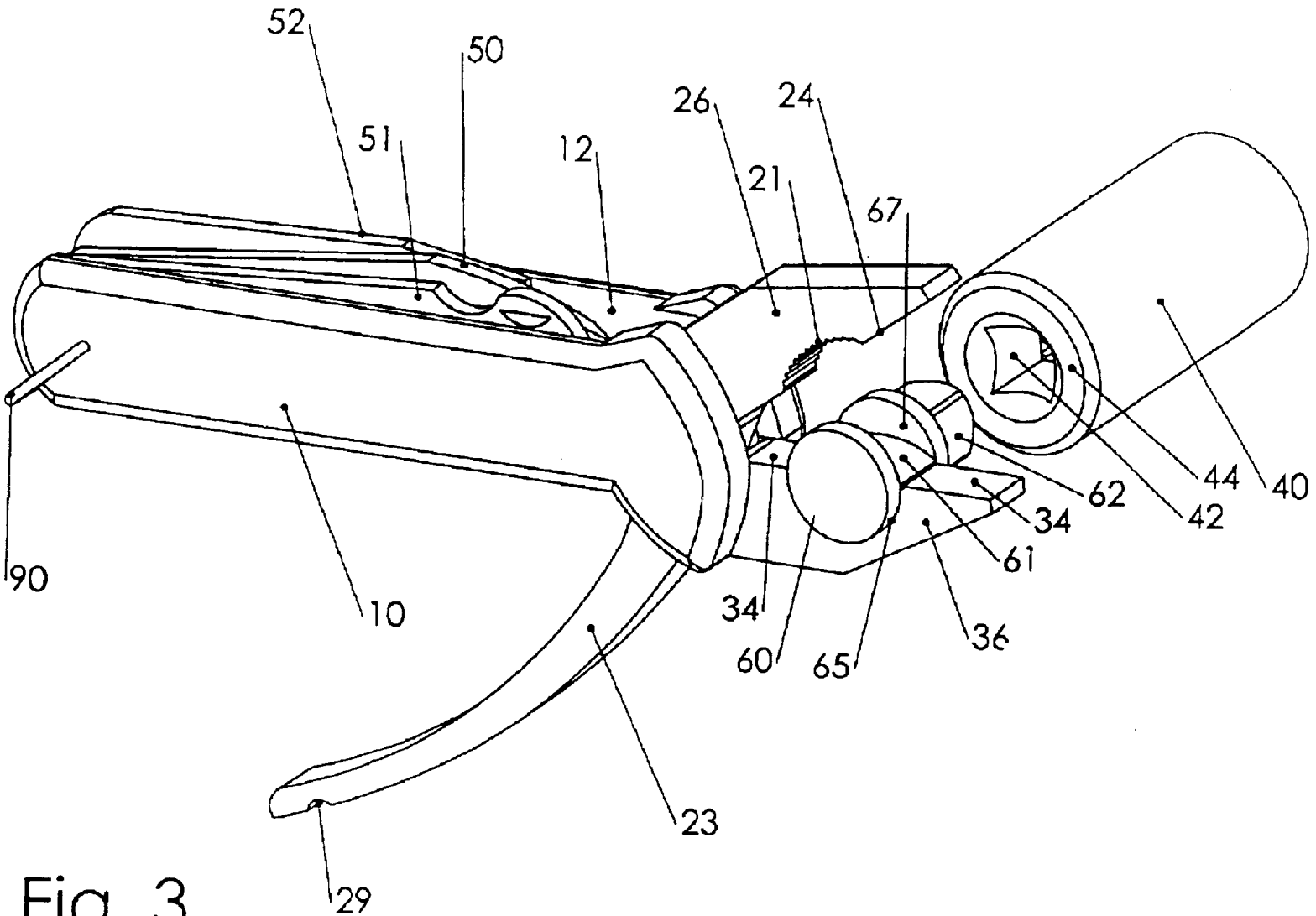
FIG. 3 is the tool assembly of FIG. 1 with an adaptor positioned upon the fixed jaw before closing the pliers, and with the other implements stored.
Figure 6:
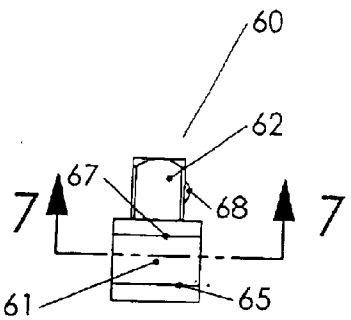
FIG. 6 is a side elevation of an adaptor.

Optionally, the driven section 61 may be non-symmetrical or asymmetrical (not shown) if, for example, it is to be used with a plier or other jaw that has a recess in only one jaw. In this embodiment, a "D" shaped section could be suitable. It may be expected that section 61 of FIG. 7 will be sturdier than 61 a of FIG. 8 since the structure of section 61 is generally thicker. The long dimension of ovoid section 61 extends in a direction parallel to and at least substantially coincident with the inside faces of the jaws, as best seen in FIGS. 3 and 10. After jaw 26 is closed, inside face 24 is coincident and parallel to the long dimension of section 61 as in FIG. 10.

An adjustable wrench, for example of the crescent wrench style, could include a recess in jaw faces as described. Then the adjustable wrench jaws could be fully closed to surround driven section 61. According to the invention, the adjustable wrench jaws are preferably fully closed to fully confine and to apply torque to the adaptor.

Optional locking loop 90 may be used for storage of the multi-purpose tool. The exemplary embodiment loop 90 is a wire bent into a rectangular shape, but the wire may be bent into a ring as well. Loop 90 pivots about body 10 to an open position as in FIGS. 1 to 3. Loop 90 is locked in FIGS. 4 and 5. When locked, as depicted in FIG. 5, loop 90 fits into slot 29 of handle 23. Inherent resilience in handle 23, loop 90, and the various linkages between the handle and the body, allows loop 90 to be forcibly pushed or snapped into and out of slot 29. Other well-known means may be used to lock the pliers shut, including hooks, straps, buckles, levers, latches, and/or cams. When used with the assembly of the invention, loop 90 will firmly hold adaptor 60 between the plier jaws.

As a benefit of the present invention construction, the movable plier handle will be restrained in a position closest to body 10. This gives the present invention tool a small silhouette for operating in cramped confines. The jaws will not open as torque is applied to the adaptor by socket 40. Importantly, disengaging loop 90 during normal use of the tool can still readily enable opening the plier jaws by allowing the movable handle to pivot away from body 10.

The relationship between ovoid section 61 and recess 21 can be seen in FIGS. 3 and 10. Adaptor 60 has been placed into recess 31, while recess 21 in position about section 61. The shape of recess 21 is equivalent to recess 31 and reasonably matches that of the facing half of section 61, shown in FIG. 10. Movable inside jaw face 24 opposes fixed inside jaw face 34, each inside face extending from a front and rear edge of the recesses, with front inside face portions of 24 and 34 extending to a distal front end of the jaws. Recesses 21 and 31 are formed into respective faces 24 and 34. These faces are shown as entirely flat in the exemplary drawings. Other contours may be desired; these include small recesses, chamfers, scallops, grooves, etc. in interior faces 24 and 34.

As seen in FIGS. 4 and 5, the assembly of the present invention is compact, with all implements stored and the plier fully closed where faces 24 and 34 are immediately adjacent and parallel to each other. In the narrow elongated space formed by recesses 21 and 31 between the fully closed plier jaws (FIG. 10), a strong torsional connection is achieved between the adaptor and the pliers because of the elongated shape of narrow section 61. Torque transmission from handle 23-body 10 to plier jaws 26, 36, to adaptor 60, and then to socket 40 is thus highly efficient. As such, there is minimal or no slippage among the linked components.

In the drawing figures, a preferred sequence of assembly is shown. In the exploded views of FIGS. 1 and 2, socket 40 and adaptor 60 are positioned on opposite sides of the plier jaws 26, 36. In FIG. 3, the adaptor is preferably first installed or positioned into the jaws. The jaws are then closed around the adaptor. Optionally, socket 40 may next be pressed onto the adaptor. This would require holding the adaptor in position in the open pliers. Finally, loop 90 is moved and positioned into slot 29. Resilience in the linkages optionally allows loop 90 to snap and lock into slot 29.

An alternative assembly sequence provides that adaptor 60 is first pressed into receptacle 42 of socket 40. The plier jaws 26, 36 are then closed about section 61 of the assembly of the adaptor and socket.

Flanges 65 and 67 hold adaptor 60 in an axial direction within plier jaws 26, 36. Flange 65 rests against or adjacent to the first side faces, visible in FIG. 1, of each of the plier jaws, while flange 67 rests against the second side faces, FIG. 2, of the plier jaws. The size and shape of the flanges are such that they are larger than driven section 61, whereby the close fitting pliers will not slide off from section 61. Plier jaws 26 and 36 are indicated at these faces in the drawing figures.

According to the present invention, adaptor 60 is fully confined between plier jaws 26, 36, FIGS. 4 and 5; that is, axially by flanges 65, 67 of adaptor 60 and radially by the enclosure formed by proximate faces 24 and 34 to each side of recesses 21 and 31.

Faces 24 and 34 of the plier jaws need not be in contact when jaws 26, 36 are completely closed together. In one alternative embodiment, some portions of the faces may be spaced apart near recesses 21 and 31, even when the jaws are completely closed together. The space should preferably be less than the width or thickness (in the vertical direction on the page in FIGS. 7 and 10) of section 61. Furthermore, the spaced apart faces 24, 34 define planes that may be parallel or askew to each other, or touch at one point.

Even with the faces spaced apart, adaptor 60 still cannot move radially (i.e., parallel to the page in FIGS. 7 and 10) and unintentionally out of the opening in the closed jaws formed by recesses 21 and 31. In the normal course of use, the plier jaws can be opened by unlatching the handle from the optional loop and the adaptor is thus freed to disengage from the plier jaws. The empty pliers are then quickly available for use in other applications.

The present invention thus provides advantages over the prior art adaptors where the adaptor is typically permanently confined in the radial direction. Indeed, in the prior art, there is either no mechanism to fully axially confine the adaptor or the adaptor is axially held permanently by a retaining ring or analogous structure fitted to a top end of the adaptor. In marked contrast, the present invention adaptor 60 is fully confined both axially by flanges 65, 67 and radially by the plier jaws 26, 36, yet the adaptor is quickly and immediately releasable from the tool assembly in the ordinary course of use.

In the drawing figures, an exemplary embodiment universal socket 40 is shown. Socket 40 may be of the type disclosed in U.S. Pat. Nos. 5,622,090 and 5,791,209 to Marks, whose entire-contents are hereby incorporated by reference. As seen in FIG. 2, socket 40 includes pins 48. Each pin 48 is spring biased out of the socket cavity 46 and separately movable along a pin axis. When a bolt head is pressed into cavity 46 pins that are atop the bolt head are pressed inward, while remaining extended pins surround the head. These remaining pins link the bolt head to the interior walls of cavity 46. Socket 40 can therefore drive devices of varied size and shape.

The interior walls of cavity 46 may include optional longitudinal grooves or scallops so that each pin of an outer perimeter of pins fits into one such groove. When the multi-purpose tool of the present invention is used with a universal socket the assembly provides wide utility in numerous applications. The applications include those enabled by the implements 50 to 52, pliers, and driving nearly unlimited shapes of fasteners with the universal socket. Alternatively, the multi-purpose tool and adaptor of the present invention may be used to drive conventional socket wrenches.

What is claimed is:

1. A multi-purpose tool assembly comprising:

a multi-purpose tool including an elongated body, a cavity in the body containing individual implements, a movable plier element pivotally attached to the body including a rearward extending movable handle and a forward extending movable jaw, a fixed jaw extending forward from the body, the fixed jaw opposed to the movable jaw, the movable jaw having a movable inside jaw face, the fixed jaw having a fixed inside jaw face, each inside jaw face having respective recesses, the jaws including an open position where the movable inside jaw face is spaced apart from the fixed inside jaw face, the jaws further including a closed position where the movable inside jaw face is immediately adjacent to the fixed inside jaw face, the closed position including an elongated enclosed opening in the jaws formed by the respective recesses in the jaw faces;

an adaptor including a polygonal-sectioned driving end and a further driven section of narrow, elongated sectional shape, the driven section positioned within the enclosed elongated opening of the jaws in the closed position of the jaws, a length of the narrow elongated sectional shape being parallel and coincident with the respective closed inside jaw faces;

the adaptor including an upper and a lower flange, the lower flange being positioned between the driving end and the driven section, the upper flange positioned on an opposite end of the driven section from the lower flange, the closed plier jaws positioned between the respective upper and lower flanges; and the adaptor being fully confined in an axial direction by the flanges of the adaptor about the plier jaws in the closed position, the adaptor further being fully confined radially in the plier jaw closed position by the elongated enclosed opening surrounding the driven section, the adaptor being unconfined by the plier jaws in the jaw open position.

2. The multi-purpose tool assembly of claim 1, wherein a socket wrench includes a square sectioned receptacle, and the driving end of the adaptor engages the square receptacle.

3. The multi-purpose tool assembly of claim 2, wherein the socket includes a universal socket having a plurality of bundled, separately movable pins within a socket body.

4. The multi-purpose tool assembly of claim 1, wherein the narrow elongated shape of the driven section includes an ovoid sectional shape.

5. The multi-purpose tool assembly of claim 1, wherein the narrow elongated shape of the driven section includes a length and a maximum width, and the length is at least two times the maximum width, the length extending to distal ends of the driven section.

6. The multi-purpose tool assembly of claim 5, wherein the adaptor presses within the elongated opening in the jaws near the distal ends of the elongated driven section of the adaptor.

7. The multi-purpose tool assembly of claim 4, wherein the ovoid shape includes two convex arcuate surfaces and the adaptor presses upon the elongated opening in the jaws at ends of the arcuate surfaces.

8. The multi-purpose tool assembly of claim 1, wherein the movable plier handle is locked by a locking device in a position closest to the elongated tool body, and the respective jaws are held closed about the driven section of the adaptor.

9. A multi-purpose tool assembly comprising:

an adaptor including a polygonal-sectioned driving end and a driven section of narrow elongated sectional shape, the driven section including an ovoid sectional shape with two arcuate surfaces joined at arc ends, the arc ends being at distal ends of a length of the driven section, a distance between the distal ends defining a torsion arm;

the adaptor including an upper and a lower flange, the lower flange being positioned between the driving end and the driven section, the upper flange positioned on an opposite end of the driven section from the lower flange;

a pair of plier jaws pivotally linked to each other, the jaws closed around the driven section of the adaptor, the jaws including an elongated recess in an inside face of at least one jaw, respective inside faces of the closed jaws being substantially adjacent and parallel to each other;

the adaptor being fully confined in an axial direction by the flanges of the adaptor being positioned against side faces of the closed plier jaws, the adaptor further being fully confined radially in the elongated recess in the closed plier jaw, the closed plier jaws surrounding the driven section at the recess; and the driven section including two distal ends and a torsion arm linking the adaptor to the plier jaws, a length of the torsion arm being defined by a distance between the distal ends of the driven section.

10. The multi-purpose tool assembly of claim 9, wherein the plier jaws are integrated as part of a multi-purpose tool, the multi-purpose tool including a body, and one of the plier jaws is fixed to the body, the body including a cavity with implements contained with the cavity, the implements including at least one knife blade.

11. The multi-purpose tool assembly of claim 10, wherein the assembly includes a socket wrench, the socket wrench having a square receptacle, and wherein the polygonal-sectioned driving end of the adaptor engages the square receptacle, and the plier jaws are torsionally linked to the socket wrench through the adaptor.

12. The multi-purpose tool assembly of claim 9, wherein the plier jaws include an open position, the open position being available in the ordinary course of use of the multi-purpose tool, the open position providing that the adaptor is released from the multi-purpose tool.

13. A multi-purpose tool assembly comprising:

an adaptor including a square sectioned driving end and a driven section of narrow elongated sectional shape, the driven section including an ovoid sectional shape with two convex arcuate surfaces joined at arc ends, the arc ends being at distal ends of a length of the driven section, a distance between the distal ends defining a torsion arm, a maximum width of the driven section being a distance between midpoints of the convex arcuate surfaces;

the adaptor including an upper and a lower flange, the lower flange being positioned between the driving end and the driven section, the upper flange positioned on an opposite end of the driven section from the lower flange;

a pair of jaws linked to each other, the jaws closed around the driven section of the adaptor, the jaws including an elongated recess in an inside face of at least one jaw to form an elongated opening in the closed plier jaws, respective inside faces of the closed jaws being substantially adjacent and parallel to each other, forward portions of the respective inside faces being spaced apart by a distance less than the maximum width of the driven section;

the adaptor being fully confined in an axial direction by the flanges of the adaptor being positioned against side faces of the closed plier jaws, the adaptor further being fully confined radially in the elongated opening in the closed plier jaw, the closed plier jaws surrounding the driven section at the opening;

the driven section including two distal ends and a torsion arm linking the adaptor to the plier jaws, a length of the torsion arm being defined by a distance between the distal ends of the driven section.

14. The multi-purpose tool assembly of claim 13, wherein the length of the driven section is at least two times the maximum width of the driven section.

15. A multi-purpose tool system comprising:

a multi-purpose tool including an elongated body, a cavity in the body containing individual implements pivotably mounted to the body;

a movable plier element pivotally attached to the body including a rearward extending movable handle and a forward extending movable jaw, a fixed jaw extending forward from the body, wherein the fixed jaw opposes the movable jaw in a closed position, and wherein the jaws include recesses to form an opening in the closed position;

a loop pivotably disposed on the body and reversibly engaging the movable handle at a rearward location to immobilize the handle against the body;

an adaptor including upper and lower flanges, a driving end, and a driven section, wherein the driven section includes a narrow, elongated sectional shape, and wherein the driven section is positioned within the opening and engages the closed jaws with the upper and lower flanges straddling the closed jaws; and a universal socket tool having a plurality of bundled, separately movable pins within a socket body, wherein the socket tool engages the driving end of the adaptor.

16. The multi-purpose tool system of claim 15, wherein the driven section includes a sectional shape having an exterior contour that substantially matches a perimeter of the opening in the closed jaws.

17. The multi-purpose tool system of claim 15, wherein the driven section includes an elongated, polygonal cross-sectional shape.

* * * * *

UNITED STATES PATENT AND TRADEMARK OFFICE

CERTIFICATE OF CORRECTION

PATENT NO. : 6,792,835 B1 
DATED : September 21, 2004
INVENTOR(S) : Stephen Quick, Joel S. Marks and Michael Marks It is certified that error appears in the above-identified patent and that said Letters Patent is hereby corrected as shown below:

Column 1,
Line 7, insert -- of co-pending -- after "application".
Line 9, insert -- , -- after "abandoned".

Column 5,
Line 19, delete "61 a" and insert -- 61a --.

Column 7,
Line 4, delete "entire-contents" and insert -- entire contents --.

Signed and Sealed this

Twelfth Day of April, 2005

JON W. DUDAS
*Director of the United States Patent and Trademark Office*